US005265591A

United States Patent [19]

Ferguson

[11] Patent Number: 5,265,591

[45] Date of Patent: Nov. 30, 1993

[54] MASK STRAP RETAINER CLIP FOR THREADED SNORKEL TUBE

[75] Inventor: Arthur R. Ferguson, Northbrook, Ill.

[73] Assignee: Dacor Corporation, Northfield, Ill.

[21] Appl. No.: 878,843

[22] Filed: May 5, 1992

[51] Int. Cl.[5] ..... B63C 11/16

[52] U.S. Cl. ..... 128/201.11; 128/201.27; 24/339

[58] Field of Search ..... 128/201.11, 200.24, 128/201.27, 201.26; 24/336, 339, 486, 531; 403/24, 52, 164; 2/2.1 R, 422

[56] References Cited

U.S. PATENT DOCUMENTS

| | | | |
|---|---|---|---|
| 3,814,090 | 6/1974 | Hill | 128/145 A |
| 4,066,077 | 1/1978 | Shamlian | 128/145 A |
| 4,562,836 | 1/1986 | Perron | 128/201.11 |
| 4,834,084 | 5/1989 | Walsh | 128/201.11 |
| 4,907,582 | 3/1990 | Meyerrose | 128/201.11 |
| 5,020,191 | 6/1991 | Uke | 128/201.11 |

FOREIGN PATENT DOCUMENTS 166252 8/1991 China .

*Primary Examiner*—Edgar S. Burr
*Assistant Examiner*—Lynn D. Hendrickson
*Attorney, Agent, or Firm*—Welsh & Katz, Ltd.

[57] ABSTRACT

A combination snorkel breathing tube and mask strap retainer clip includes a snorkel breathing tube having an externally threaded portion, a tubular barrel configured to circumscribe the threaded breathing tube, a tooth disposed on the tubular barrel for engaging the threads of the breathing tube to adjust the vertical position of the barrel relative to the breathing tube, a mask strap retainer and a retaining stud disposed on the tubular barrel and configured for swivelingly accommodating the mask strap retainer thereon.

15 Claims, 1 Drawing Sheet

MASK STRAP RETAINER CLIP FOR THREADED SNORKEL TUBE

RELATED APPLICATION

This application is related to commonly-assigned copending U.S. application Ser. No. 07/766,053, filed Sep. 26, 1991 and entitled "MODULAR SNORKEL" now U.S. Pat. No. 5,199,422, the subject matter of which is incorporated by reference herein.

BACKGROUND OF THE INVENTION

The present invention relates generally to a fresh air diving snorkel of the type used in the sport of skin diving, and particularly to a snorkel having a mask strap retainer clip associated therewith which is vertically adjustable relative to the snorkel breathing tube, and which allows the snorkel breathing tube to be pivotally disposed relative to the diving mask strap to which it is attached.

A common problem of conventional snorkels is the form of attachment used to secure the breathing tube to the mask. Ideally, the snorkel should be secured to the mask strap for lateral support of the upper portion of the snorkel tube while swimming to minimize fatigue on the diver's mouth. In addition, while scuba diving with the assistance of pressurized air tanks, the snorkel is desirably held to the mask strap out of the way of the diver's mouth.

A conventional type of attachment takes the form of a pair of elastic rings joined together by an elastic band to be passed around the strap of the mask. The breathing tube is inserted through the elastic rings to secure the tube to the mask strap. This system is inconvenient because the snorkel mouthpiece is maintained relative to the mask in a position which cannot be easily changed or adjusted. This is especially cumbersome during diving, when it is often necessary to remove the mouthpiece from the diver's mouth while changing from a mouthpiece breathing system to an auto-respirator system.

Another drawback of conventional snorkel mask strap retainers is that they tend to pull the hair of the diver when a diving hood is nor worn. Also, the elastic rings generally do not last very long since they are pulled or stretched quite often, particularly when the mouthpiece of the breathing tube is inserted into the mouth or removed therefrom. Moreover, since these rings exert a gripping action on the tube and thus cannot be readily moved vertically therealong for adjustment, the breathing tube is often inconveniently held and/or positioned and, as a consequence, the tube undergoes vibration as the diver swims and water may be more easily admitted. If the breathing tube is improperly positioned, the mouthpiece has a tendency to spring away from the mouth, resulting in inconvenience to the diver as well as discomfort.

Thus, an object of the present invention is to provide a snorkel having a mask strap attachment device which is durable and is lockably adjustable in several directions for maximization of diver comfort.

Another object of the present invention is to provide a mask strap retainer clip for a snorkel which is vertically adjustable upon an externally ridged portion of the snorkel breathing tube.

Still another object of the present invention is to provide a mask strap retainer clip which is securely retained upon the snorkel breathing tube.

Yet another object of the present invention is to provide a mask strap retainer clip which includes a swiveling mask strap retainer portion.

SUMMARY OF THE INVENTION

The above-identified objects are achieved or exceeded in the present mask strap retainer clip, which is preferably designed for use with a snorkel breathing tube having an externally threaded or otherwise ridged portion. Once fastened to the breathing tube, the present mask strap retainer clip cannot be removed without major disassembly.

More specifically, the present invention provides a combination snorkel breathing tube and mask strap retainer clip, including a snorkel breathing tube having an externally threaded portion. The mask strap retainer clip includes a tubular barrel configured to circumscribe the threaded breathing tube, a tooth disposed on the tubular barrel for engaging the threads of the breathing tube to adjust the vertical position of the barrel relative to the breathing tube, a mask strap retainer, and a retaining stud disposed on the tubular barrel and configured for swiveling accommodating the mask strap retainer.

The present invention also provides a mask strap retainer clip for axial and rotational adjustment relative to a snorkel breathing tube having an externally ridged portion, including a tubular barrel circumscribing and being vertically adjustable realtive to the breathing tube. The clip also includes a tooth fixed relative to the tubular barrel and disposed thereon for engaging the ridged portion on the breathing tube, a retaining stud for swivelingly securing a mask strap retainer to the tubular barrel, and a mask strap retainer for releasably retaining a mask strap therein.

DESCRIPTION OF THE PREFERRED EMBODIMENT

Figure 1:
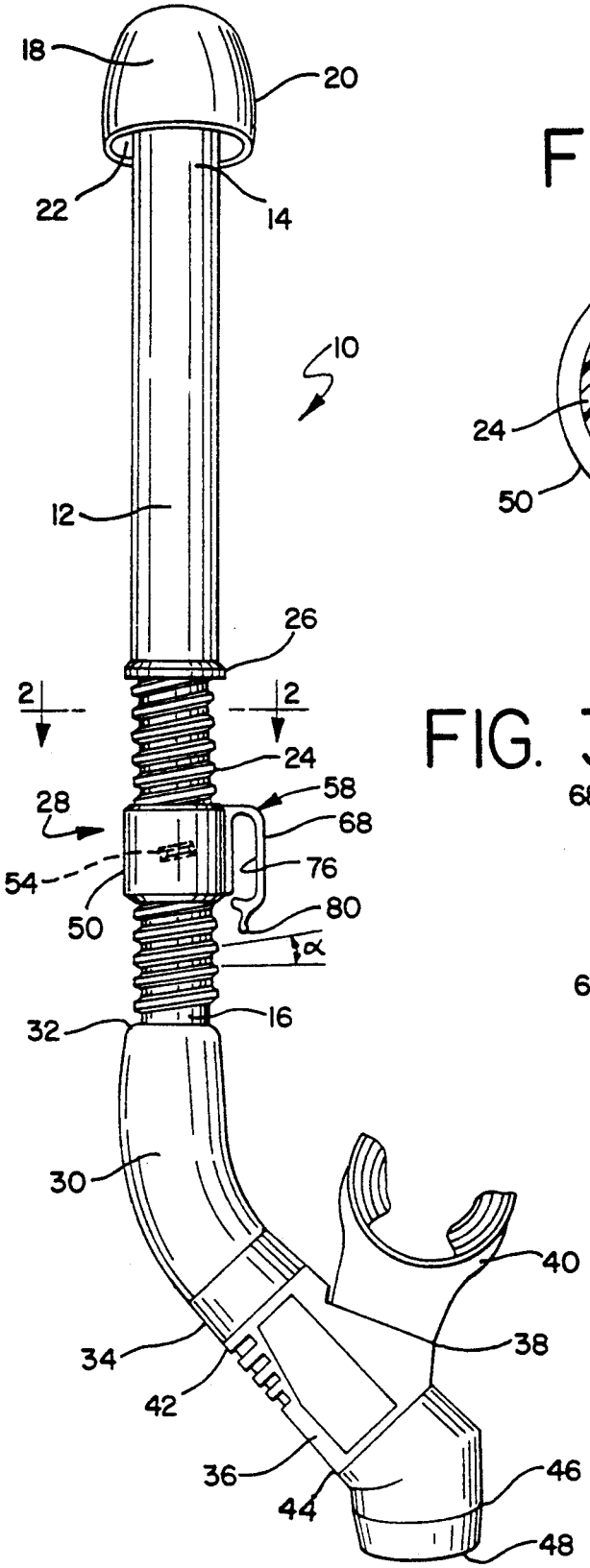
FIG. 1 is a front elevational view of a diving snorkel incorporating the present mask strap retainer clip.

Referring now to FIG. 1, a snorkel of the type suitable for use with the present mask retainer clip is generally indicated at 10. The snorkel 10 includes a breathing tube 12 having an upper end 14 and a lower end 16, both of which are open. The breathing tube 12 may be made of any self-supporting material having the characteristics of slight flexibility, chemical and ultraviolet resistance, scuff and mar resistance, and the ability to be produced in a variety of distinctive colors. A preferred material for the breathing tube 12 is semi-rigid polyurethane.

An upper value 18 is positioned at the upper end 14 of the breathing tube 12. The valve 18 includes a valve housing 20 which is made of plastic material having light weight and durability, low water absorption, high impact resistance, and which may be molded in relatively thin wall sections to "cut" through the water to further reduce drag. Housing 20 is configured with a greater diameter than the diameter of the tube 12, so that the housing defines a gap 22 between the housing and the tube. The valve 18 is designed so that air may easily enter the tube through the gap 22, and water is prevented from entering the tube 12 through the protective action of the housing 20 and the valve. However, water cleared from the tube 12 by the diver easily passes out through the valve 18.

A plurality of vertically spaced, radially projecting ridges 24 are disposed on the breathing tube 12 adjacent the lower end 16. The ridges 24 define a band on the tube 12 having a generally corrugated appearance. In the preferred embodiment, the ridges 24 form a helical thread, although other configurations, such as concentric, spaced ridges, are also contemplated. The preferred threaded ridges have an angular pitch designated by the angle $\alpha$.

A radially extending lip 26 defines the upper end of the ridges 24 and acts as an upper stop for the present mask strap clip, designated generally at 28. Above the ridges 24, the breathing tube 12 has a slightly sweeping curved configuration (not visible in FIG. 1), and it is contemplated that the degree and direction of curve may vary as desired; however, it is preferred that the tube have a slightly swept back profile to minimize drag when swimming underwater.

The lower end 16 of the tube 12 is preferably provided with a formation (not shown) for accommodating a connector tube 30 which matingly engages the lower end of the breathing tube and has an upper end 32 and a lower end 34. The upper end 32 of the connector tube acts as a lower stop for the mask strap clip 28. The lower end 34 matingly engages a snorkel body 36 to place the breathing tube 12 and the snorkel body in fluid communication with each other, as well as to physically connect the two components.

Connector tube 30 is preferably made of a relatively soft synthetic material which will be self sealing when frictionally pressed upon the corresponding mating portions of the breathing tube 12 and the snorkel body 36. In other words, special adhesives, O-rings and/or clamps are not needed to prevent water from entering the snorkel at the junction of the connector tube 30 at either the breathing tube 12 or the snorkel body 36. A preferred material for the connector tube 30 is thermoplastic rubber having a hardness in the range of 40–60 Durometer, with 45–55 Durometer being preferred.

The snorkel body 36 is provided with a central passageway (not shown) which is in fluid communication with the connector tube 26 as well as a mouthpiece attachment port 38. Additional structural details of a snorkel body suitable for use with the present invention is disclosed in commonly-assigned U.S. Pat. No. 5,199,422, which is incorporated by reference. A conventional regulator-style mouthpiece 40 is friction fit upon the attachment port 38. It is contemplated that other conventional mouthpiece styles may be alternatively employed.

The body 36 also has an upper end 42 and a lower end 44. The upper end 42 is configured to matingly engage the lower end 34 of the connector tube 30. At the lower end 44, a drain port 46 is provided and configured for fluid communication with the body 36, and may be fitted with a drain valve 48.

Figure 2:
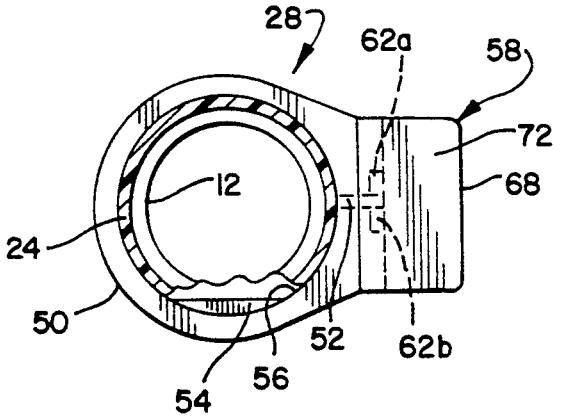
FIG. 2 is a sectional view taken along the line 2—2 of FIG. 1 and in the direction indicated generally, with portions shown cut away for clarity.
Figure 3:
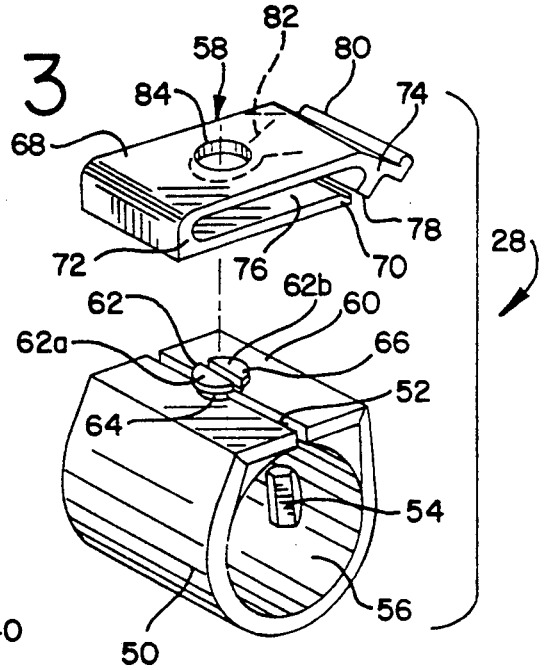
FIG. 3 is an exploded top perspective view of the present mask strap retainer clip.

Referring now to FIGS. 1–3, the present mask strap retainer clip 28 includes a tubular barrel 50 having a longitudinally defined slit 52 which preferably extends the full length of the barrel. The barrel 50 is configured to circumscribe the breathing tube 12 in the area of the ridges 24. The barrel is preferably constructed of semi-rigid, plastic material such as acetal, which imparts a spring biasing force to the barrel to resist separation of the barrel along the slit 52.

At least one tooth 54, which in the preferred embodiment is an Acme tooth, is located on an interior surface 56 of the barrel 50 and is configured to project inwardly from the surface 56 for engaging the ridges 24 of the breathing tube 12, especially in the threaded configuration illustrated in FIG. 1. When the ridges 24 are threaded, the tooth 54 is disposed at an angle which is approximately equal to the angular pitch of the threads. Axial rotation of the clip 28 about the breathing tube 12 adjusts the vertical position of the barrel 50 relative to the breathing tube. In addition, when the ridges 24 are threads, vertical movement of the barrel 50 will also change the rotational orientation of the barrel relative to the breathing tube 12.

A mask strap retainer portion, generally indicated at 58 is provided to the clip 28 for releasable attachment to the strap of a diving mask worn by the diver. Both the barrel 50 and the strap retainer portion 58 are preferably made of a durable, environmentally resistant material such as acetal.

The barrel 50 also includes a generally flat face 60 upon which the strap portion 58 swivels. In the preferred embodiment, the strap portion 58 may be swiveled about an axis which is perpendicular to the axis of the tubular barrel 50 and which is represented by a retaining stud 62. The retaining stud 62 is preferably an integral portion of the tubular barrel 50 and includes a narrowed neck 64 and a relatively large, disk-shaped head 66. It is preferred that the retaining stud 62 be centrally located upon the flat face 60.

Strap portion 58 includes an outer wall 68 and an inner wall 70, which are joined along respective common upper and lower edges 72, 74 in spaced, parallel relationship to each other to define a mask strap passageway 76. The inner wall 70 has a transverse slit 78 to facilitate the insertion of a mask strap into the passageway 76. A finger tab 80 is formed at the lower edge 74 of the outer wall 68 to assist the diver in overcoming the inherent spring force of the strap portion 58. The diver thus spreads apart the outer and inner walls 68, 70 to open the transverse slit 78 for insertion of the strap. The inner wall 70 is provided with a generally keyhole-shaped opening 82 (shown hidden) dimensioned so that the strap portion 58 may be releasably locked onto the retaining stud 62 for rotation thereabout. If desired, the outer wall 68 may be provided with an opening 84 to facilitate the forming of the opening 82 in an injection molding apparatus.

The slit 52 is cut into the flat face 60 to enable the barrel 50 to be placed upon the ridged portion of the breathing tube 12 through lateral pressure without being inserted over either the upper end 14 or the lower end 16. The slit 52 preferably splits the retaining stud 62 into first and second portions, 62*a* and 62*b*. In fact, in the preferred embodiment, the slit 52 bisects the stud 62, although other relative positions for the slit 52 and the stud 62 are contemplated.

The barrel 50 is secured to the breathing tube 12 by the inherent spring-biasing force which resists separation along the slit 52, and also by the strap portion 58 through a tight, yet releasable locking friction fit engagement of the retaining stud 62 by the keyhole shaped opening 82 in the inner wall 70. Specifically, the dimensions of the opening 82 are such that when the stud 62 is engaged, both portions 62*a* and 62*b* are clamped together, preventing the unwanted removal of the barrel 50 from the breathing tube 12.

An advantage of the present clip 28 is that once the strap portion 58 is secured upon the barrel 50, the barrel may only be removed from the breathing tube by removal of the strap portion. In this manner, the snorkel is retained by the mask strap more securely than in conventional mask strap retaining fastening systems. Furthermore, the inherent spring action of the respective outer and inner walls 68, 70 of the mask strap portion 58 to a closed position in the area of the transvers slit 78 prevents unwanted disengagement of the mask strap.

Beneficial features of the present clip 28 include that the tubular barrel 50 can rotate 360° about the tube 12, is vertically adjustable on the tube, and the strap portion 58 can also rotate 360° about the barrel 50. The respective rotation and swiveling action of the barrel 50 and the strap portion 58 are independent of each other. Also, the configuration of the barrel 50 and the tooth 54 is such that the engagement upon the ridges 24, whether threaded or not, is relatively tight, requiring some diver effort in adjusting the relative vertical position of the barrel upon the breathing tube 12. Once adjusted, the clip 28 will not easily move relative to the snorkel breathing tube 12.

While a particular embodiment of the mask strap retainer clip for threaded snorkel tube of the invention has been shown and described, it will be appreciated by those skilled in the art that changes and modifications may be made thereto without departing from the invention in its broader aspects and as set forth in the following claims.

What is claimed is:

1. A combination snorkel breathing tube and mask strap retainer clip, comprising:

a snorkel breathing tube having an externally helically threaded portion;

a mask strap retainer clip including a tubular barrel configured to circumscribe said threaded breathing tube;

tooth means disposed on said tubular barrel for engaging said helically threaded portion of said breathing tube to adjust the vertical position of said barrel relative to said breathing tube by axially rotating said barrel about said breathing tube;

mask strap retainer means on said retainer clip for retaining a mask strap; and retaining stud means disposed on said tubular barrel and configured for swiveling engagement of said mask strap retainer means thereon.

2. The combination as defined in claim 1 wherein said barrel has a longitudinally defined slit which splits said retaining stud means into first and second portions.

3. The combination as defined in claim 2 wherein said mask strap retainer means includes a strap portion having an opening configured to maintain said first and second portions of said retaining stud means in clamped relationship.

4. The combination as defined in claim 2 wherein said slit bisects said retaining stud means.

5. The combination as defined in claim 1 wherein threads of said threaded portion have a specified angular pitch inclined relative to a horizontal plane, and said tooth means includes a single tooth disposed on said barrel at an angular pitch which corresponds to said pitch of said threads.

6. The combination as defined in claim 5 wherein said tooth means includes an Acme tooth.

7. The combination as defined in claim 1 wherein said mask strap retainer means includes a mask strap passageway defined by the walls of a spring-biased mask strap portion configured for said swiveling engagement of said retaining stud means.

8. The combination as defined in claim 7 wherein said mask strap portion further includes an inner wall and an outer wall and a keyhole-shaped opening in said inner wall, said opening configured to releasably engage said retaining stud means.

9. The combination as defined in claim 8 wherein said inner wall includes a transverse slit for facilitating the separation of said inner and outer wall for removable insertion of a mask strap.

10. A mask strap retainer clip for axial and rotational adjustment relative to a snorkel breathing tube having an externally helically threaded portion, comprising:

a tubular barrel circumscribing and being vertically adjustable relative to said breathing tube;

tooth means fixed on said tubular barrel and disposed thereon at an inclination relative to a horizontal plane for engaging said threads on said breathing tube and for adjusting the vertical position of said barrel relative to said breathing tube by axially rotating said barrel about said breathing tube;

retaining stud means for providing swiveling engagement of mask strap retainer means to said tubular barrel; and mask strap retainer means for releasably maintaining a mask strap therein.

11. The clip as defined in claim 10 wherein said retaining stud means includes a stud disposed on said tubular barrel, said stud being configured for providing said swiveling engagement of said mask strap retainer means to said tubular barrel.

12. The clip as defined in claim 11 wherein said mask strap retainer means includes a mask strap passageway defined by inner and outer walls of a spring-biased mask strap portion configured for said swiveling engagement of said retaining stud means through an opening in said inner wall.

13. The clip as defined in claim 12 wherein said tubular barrel has a longitudinally defined slit which splits said stud into first and second portions, and said mask strap portion engages said stud to maintain said first and second portions in clamped relationship.

14. A mask strap retainer clip for axial and rotational adjustment relative to a snorkel breathing tube having an external helically threaded portion, comprising:

a tubular barrel configured to circumscribe the threaded breathing tube;

tooth means disposed on said tubular barrel for engaging said threads of the breathing tube to adjust the vertical position of said barrel relative to the breathing tube by axially rotating said barrel about the breathing tube;

mask strap retainer means; and retaining stud means disposed on said tubular barrel and configured for swiveling engagement of said mask strap retainer means thereon, said retaining stud means including a stud split by a longitudinally defined slit in said tubular barrel, said stud being configured to both releasably lock the mask strap retainer means onto the breathing tube and to form a swivel axis for rotation of said mask strap retainer means relative to said tubular barrel.

15. The clip as defined in claim 14 wherein said tooth means includes a tooth disposed on an inner surface of said tubular barrel, said tooth being configured for engagement with the threaded portion of the breathing tube to maintain the vertical position of said tubular barrel relative to the threaded portion while still being rotatable about the axis of the breathing tube. f

* * * * *